United States Patent [19]

Fetner

[11] Patent Number: 5,052,057

[45] Date of Patent: Oct. 1, 1991

[54] ADJUSTABLE CHILD'S GLOVE

[75] Inventor: Beth R. Fetner, Rockville Center, N.Y.

[73] Assignee: Baby D Mittens, Inc., Rockville Center, N.Y.

[21] Appl. No.: 546,413

[22] Filed: Jun. 29, 1990

[51] Int. Cl.[5] ..... A41D 19/01

[52] U.S. Cl. ..... 2/158; 2/DIG. 6

[58] Field of Search ..... 2/16, 20, 158, 159, 2/161 A, 161 R, 169, DIG. 6; 16/116 A; 128/381

[56] References Cited

U.S. PATENT DOCUMENTS

| | | | |
|---|---|---|---|
| 2,069,643 | 2/1937 | Burke | 2/158 |
| 3,106,790 | 10/1963 | Zimmon | 2/DIG. 6 |
| 4,564,956 | 1/1986 | DiBuono | 2/158 |
| 4,675,918 | 6/1987 | O'Brien | 2/DIG. 6 |
| 4,769,855 | 9/1988 | Tsai | 2/DIG. 6 |

*Primary Examiner*—Werner H. Schroeder
*Assistant Examiner*—Diana L. Biefeld
*Attorney, Agent, or Firm*—Abelman, Frayne & Schwab

[57] ABSTRACT

An infant's mitten which substantially facilitates emplacement over the hand, particularly when the parent must place the mitten on a moving or closed hand. The mitten has a side opening which is closed by a fold-over flap, and secured by a releasable closure, such as Velcro. Preferably the size of the mitten may be adjusted by the engagement area of the releasable closure in conjunction with the stretchability of the fabric forming the glove, which may be knit.

16 Claims, 3 Drawing Sheets

11A
25
20
23
3
3

11A
25
20
21
22
23

ADJUSTABLE CHILD'S GLOVE

My invention is directed to a child's hand covering, such as a mitten, which is specifically designed for infant's and small children to substantially facilitate its emplacement over the child's hand, and preferably also readily permits a predetermined size adjustment.

Infant's mittens, as generally available, are typically a smaller version of the larger size apparel product. However, infants and very small children are oftentimes moving while they are being dressed. Further, very young infants are apt to have their hand closed. Accordingly, it may be difficult to place their moving and/or clenched hands within the bottom opening of the mitten. Further, mittens provided for infants or very small children usually come in only a very few sizes, thus requiring an approximate fit. Since infants and small children are experiencing growth, the parent buying the mitten desires that the product is not rapidly outgrown. Accordingly, it would be most advantageous to readily facilitate placing the mitten on the infant's hand, while preferably providing some adjustability so that one, or a small number of sizes, could snugly and comfortably accommodate a range of hand sizes and resist accidential movement.

An attempt to ease the insertion of the child's hand within a glove is disclosed in Buhl U.S. Pat. No. 2,549,660, wherein a zipper is provided along one side of either a finger type glove or mitten. The zipper is initially opened to provide an elongated opening for inserting the child's hand. When the hand is located within the interior opening of the glove, the zipper must then be rapidly closed to snugly enclose the hand within the glove. While providing some ease of inserting the child's hand within the glove, that product a) does not readily permit a variation in size to accommodate different hand sizes, b) presents the possibility that the child's hand, which is apt to be moving, could be caught within the zipper, as it is closed, and c) would not be readily placed over the closed hand of a very young infant. Further, the use of an elongated zipper significantly adds to the cost of the product, which tends to make it commercially impractical for low cost mass produced infant's mittens. Burke U.S. Pat. No. 2,069,643 discloses a beauty mitten wherein a zipper extends along the users arm. That specialty type product, designed for adult application of emollients and lotions, would be impractical for an infant's mitten.

The improved child's mitten of my invention includes two complimentary planar fabric members in overlying relationship, with one of their side edges being initially opened to provide a substantial access to the interior volume to readily facilitate the insertion of the infant's hand. One of the members includes an extending panel-like flap along at least a portion of its side opening. The flap is folded over its juncture to the glove side edge after the insertion of the child's hand. When folded over the panel overlies a portion of the other member to close the previously open side edge. Complimentary securement means are provided on the extension panel and overlied portion of the other member to releasably secure them together. When so secured, the infant's hand will be snugly enclosed within the mitten. The releasable securement means by preferably be a Velcro closure. The lateral extent of the Velcro portion is predeterminally selected so as to provide an adjustment in their exact engagement point, thereby adjusting the size of the mitten. Such a low pressure actuated closure is substantially easier to manipulate than the elongated zipper of Buhl, U.S. Pat. No. 2,549,660, partially since the infant's hand is apt to be moving.

While Velcro closures have been previously suggested, they are known for various other apparel uses, such as the golf glove of the DiBuono U.S. Pat. No. 4,564,956, the slipper of Zimmon U.S. Pat. No. 3,106,790, the baby's night gown of Tsai U.S. Pat. No. 4,769,855 and the brief of O'Brien U.S. Pat. No. 4,675,918. None of those products suggest the advantageous incorporation of an adjustable Velcro closure within the disclosed infant's mitten to provide the several practical advantages of the instant invention.

Further, the fabric forming the glove may preferably be knit, so as to provide some stretchability. The use of the Velcro closure and stretch fabric collectively enhance the size adjustment of the product to snugly contain different size infant's hands.

Accordingly, it is a primary object of this invention to provide an infant's hand covering, such as a mitten, which substantially facilitates the insertion of the hand.

A further objection of the instant invention is to provide such a child's hand covering which readily permits an adjustment in the hand size to be snugly accommodated therein.

Another object of the instant invention is to provide such a child's mitten which is constructed of an integral planar fabric which initially has a reclosable opening along one side thereof, which may be readily closed after the child's hand is inserted within the mitten.

These and other objects and advantages of this invention will become apparent to those skilled in the art upon reference to the accompanying specification, claims, and drawing in which:

Figure 4:
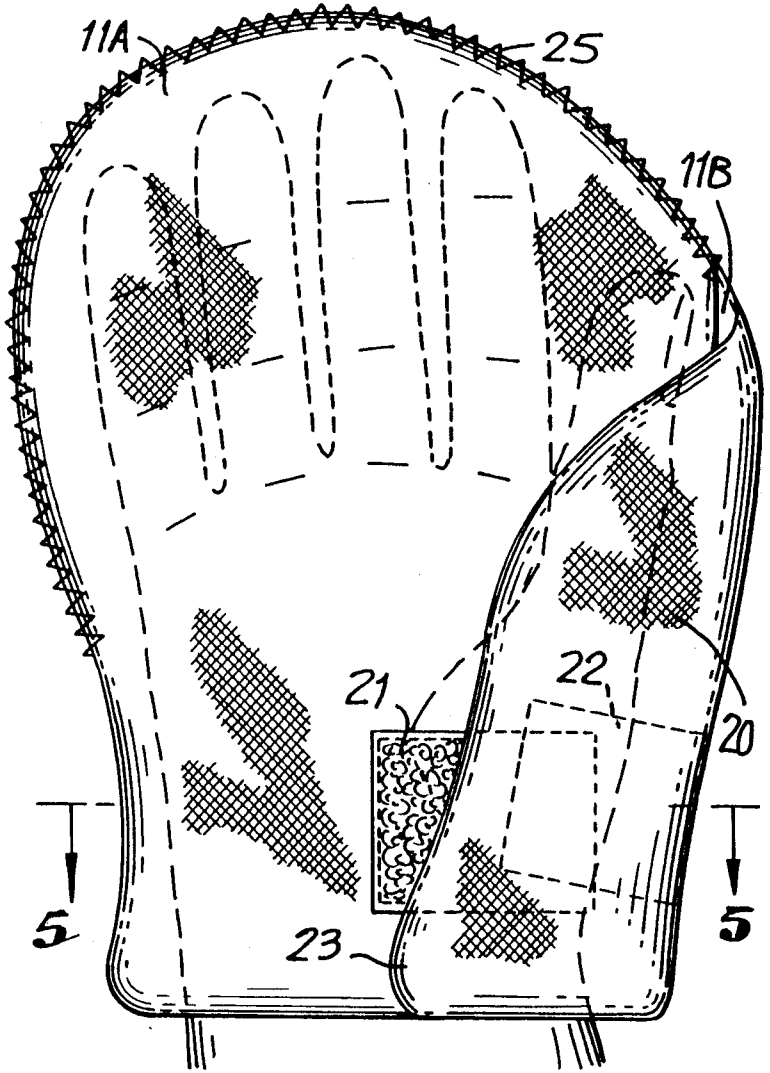
FIG. 4 is a view corresponding to FIG. 2, but showing the emplacement of a somewhat larger hand within the mitten.
Figure 3:
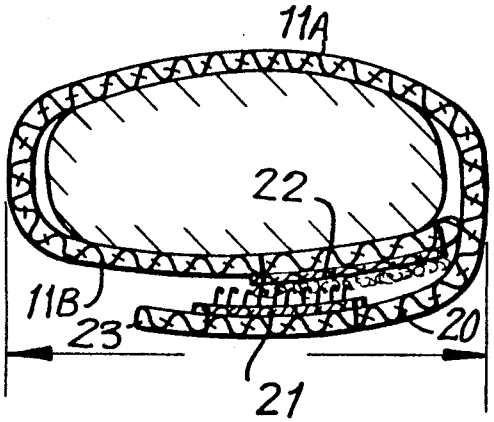
FIG. 3 is a cross sectional view along line 3—3, FIG. 2, looking in the direction of the arrows, showing the hand contained therein.
Figure 5:
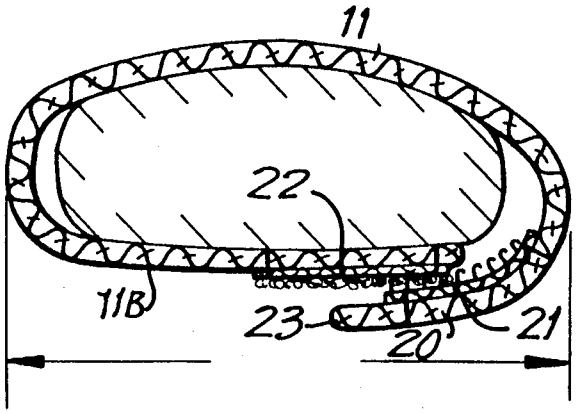

FIG. 5 corresponds to FIG. 3, and taken along the line 5—5 of FIG. 4 to show the disposition of the enclosed glove members with a larger size hand.

Figure 6:
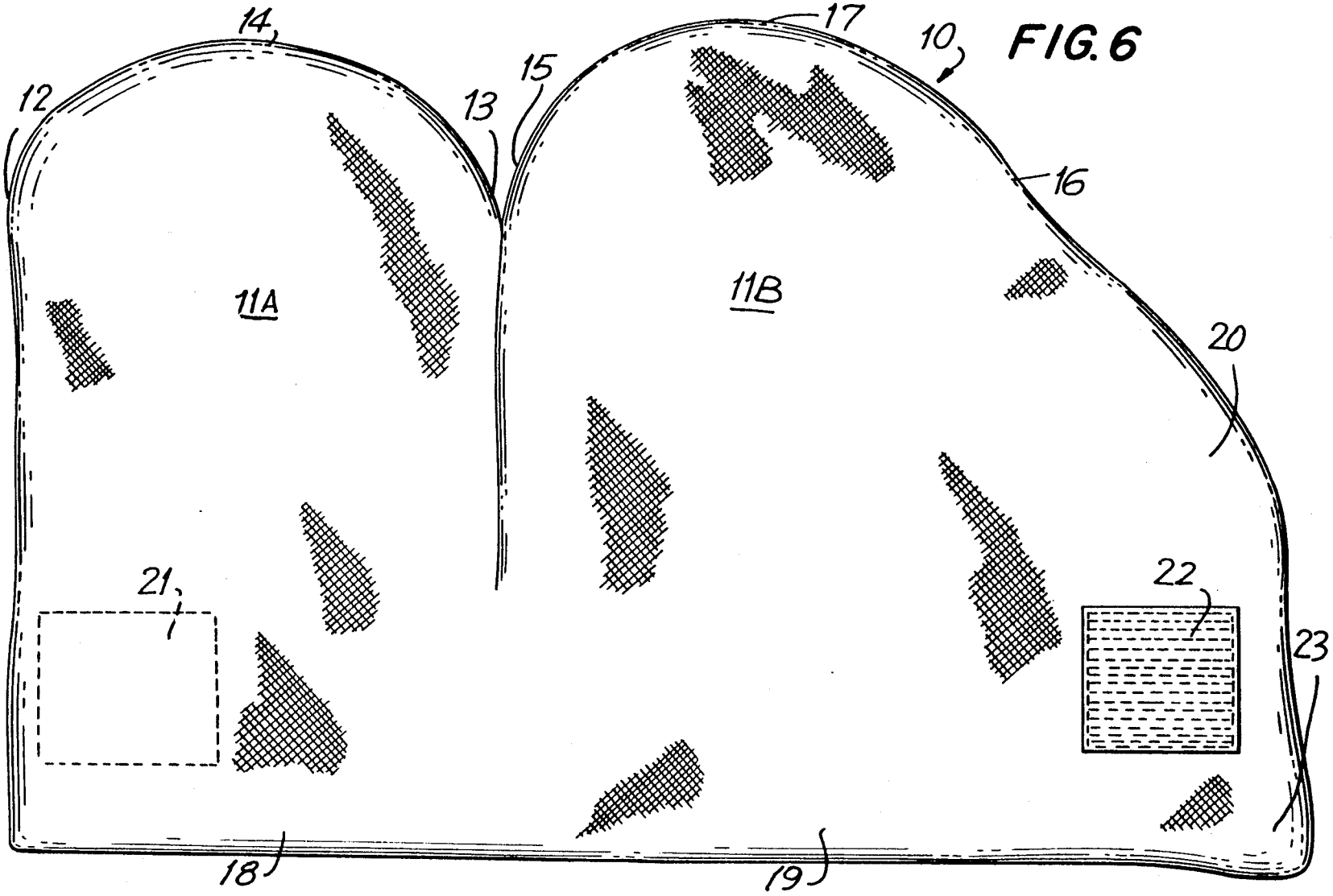

FIG. 6 is a plan view of the fabric piece forming the glove prior to this assembly.

Figure 1:
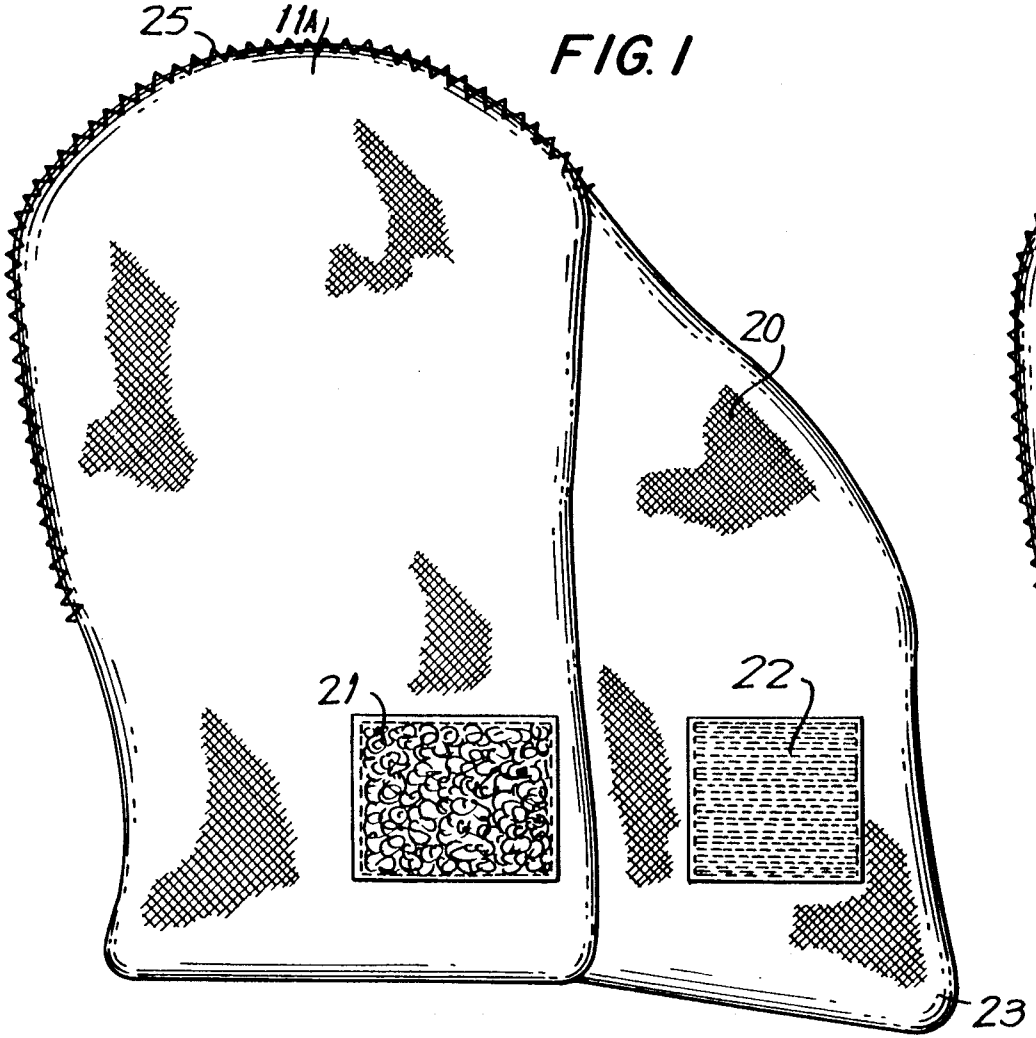
FIG. 1 is a front plan view of the assembled mitten prior to the insertion of the child's hand therein, with the reclosable side panel extension in the open condition.

Referring first to FIG. 1 and 6, the child's hand coverage shown therein is preferably in the form of a mitten that may be formed of a knit fabric. The fabric is preferably constructed of acrylic yarn for low cost and ease of washing, although other fabrics may be employed too. A stretchable fabric advantageously provides a specific degree of size adjustment such that the end product snugly accommodate itselfs to variations in the child's hand size. This helps avoid the need for a substantial number of different size mittens to snugly accommodate the anticipated variation in the hand sizes of different infants, as well as the growth pattern of an individual infant.

Planar fabric number 10 integraly includes complimentary members 11A and 11B. Fabric member 11A includes a first side edge 12, opposed second side edge 13, and a curve top edge 14. Similarly, member 11B includes a first side edge 15 (which coincides with second side edge 13 of the complimentary member 11A), opposed second side edge 16, and a curved top edge 17. The complimentary members 11A, 11B also include lower extending wrist covering portions 18 and 19 respectfully. The outer side of panel 11B may preferably include ornamentation (not shown). Member 11B, which is intended to cover the back of the hand, includes a panel extension 20. In the embodiment shown herein, the longitudinal connection of extension 20 to panel 11B substantially corresponding to the length of curved side edge 16. Alternatively, the panel extension could be confined to the lower portion of member 11B. In such a variation (not shown) edge 16 might have a more rapid vertical drop, with the panel extension extending horizontally outward therefrom. The panel extension 20 and member 11A include complimentary securement means 21, 22, which may preferably be a Velcro closure. The hook containing member 22 is secured to the panel extension member 20 and the complimentary loop containing member 21 is secured to member 11A.

To initially assemble the mitten, the planar member 11A is folded over the juncture of side edges 13 and 15 to the condition shown in FIG. 1. The members 11A, 11B, which are now in overlying relationship, are stitched together, preferably by a single line of stitching 25, which connects their complimentary side edges 13–15 and curved top edges 14–17.

In the overlying condition shown in FIG. 1, the complimentary members define an interior volume adapted to receive the child's hand. The normally unsecured side edges 12–16, in conjunction with the open bottom portion of the gloves ( at the lowermost edges of wrist extensions 18, 19) provide a substantial access opening to this interior volume. After the child's hand is easily inserted, the side access opening is thereafter enclosed by folding extension panel 20 over a portion of member 11A and securing same in such condition, as shown in FIG. 2, by the complimentary engagement of the Velcro closure elements 21–22.

Figure 2:
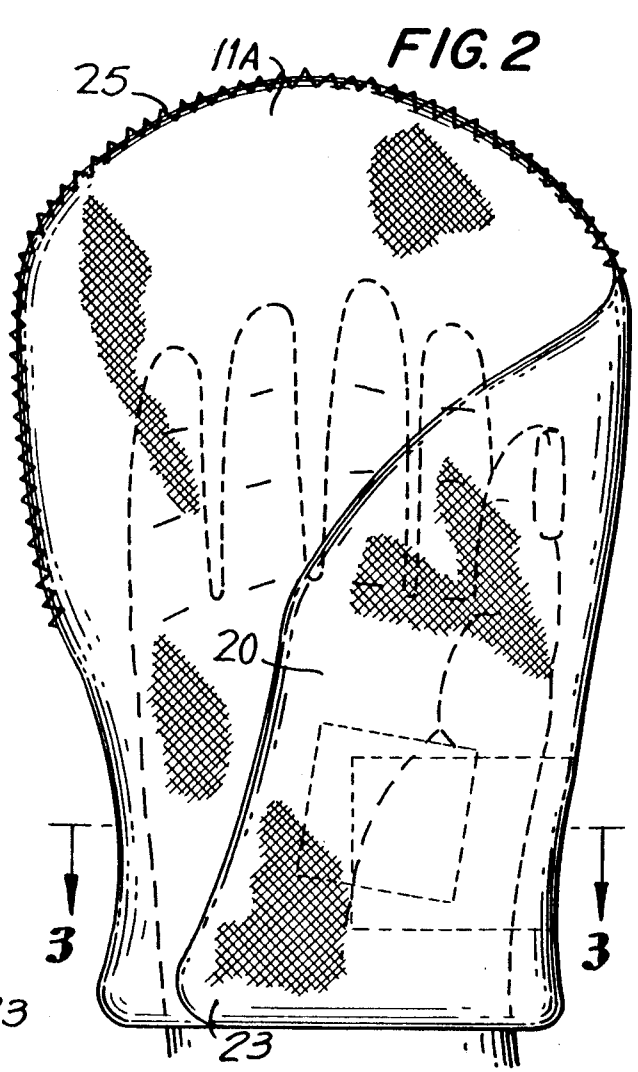
FIG. 2 is a view similar to FIG. 1, but showing the insertion of the child's hand therein and the reclosable side panel in the closed condition.

FIG. 2 shows the mitten in its closed condition, containing a hand of a size which is at the lower range of the particular mitten. Accordingly, once the child's hand is in the mitten, the Velcro closure area will be adjusted to provide a snug fit for the mitten. FIG. 4 shows a somewhat larger hand in place within the same mitten. The adaptability to such different hand sizes is readily compensated by the adjustment in the engagement point between the Velcro elements 21–22 as shown both by the FIG. 4 to FIG. 2, and FIG. 5 TO FIG. 3 comparisons.

To remove the mitten, the parent need merely grasp the end 23 of panel extension 20 to release the Velcro securement 21–22 and open up the panel extension 20.

While a preferred embodiment of the invention has been disclosed, it should be readily understood that numerous modifications and revisions thereto may be made by those skilled in the art. For example, the Velcro closure may be replaced by other securement means such as snaps. Accordingly, it is intended that the invention be limited only by the scope of the appended claims.

I claim:

1. A child's hand convering adapted to enclose at least the fingers, palm and rear portion of the hand, comprising:

first and second complimentary members in overlying relationship, to define an interior volume for the weares's hand, each of said members including a top edge, bottom edge, and first and second opposed side edges, said first and second members being permanently secured to each other along their top and only one of said side edges, the other side edges being unsecured to each other and initially open, said open side edges communicating with the bottom edges to provide a substantial access opening to said interior volume for readily inserting the child's hand therein, one of said members including a panel extension which extends sidewardly from its initially open side edge, said panel extension being foldable about its side edge juncture with its connective member to overly an appreciable area of the other member;

said panel extension and overlying area of said other member including complementary securement means, said securement means releaseably attaching said panel extension of said one member to the overlying area of the other member to close the initially open side edges of the complementary members when the child's hand is inserted within said interior volume.

2. A child's hand covering as recited in claim 1, wherein said panel extension extends from a side edge of the member overlying the rear of the hand, and is releasably attached to the member overyling the palm of the hand.

3. A child's hand covering as recited in claim 1, wherein said securement means provides for lateral adjustment to permit a variation in the size of the interiorly defined volume, to snugly accommodate different hand sizes.

4. A child's hand covering as recited in claim 3, wherein said complementary securement means is a Velcro closure.

5. A child's hand covering as recited in claim 1, wherein said complementary securement means is a Velcro closure.

6. A child's hand covering as recited in claim 1, wherein said first and scond complementary members and panel extension are integrally formed of a single piece of fabric.

7. A child's hand covering as recited in claim 6, wherein said fabric is stretchable knit.

8. A child's hand covering as recited in claim 6, wherein said child's hand covering is a mitten, having an arcuate seam closure along the complementary top edges of said first and second members.

9. A child's hand covering as recited in claim 8, wherein said complementary securement means is a Velcro closure, which include a hook portion located on one of said members and a loop portion on the other of said members, said panel extension exends from the one of said members which overlies the rear of the hand, said member containing the hook portion of the Velcro closure, the attachment or said hook portion to the other member which overlies the front of the hand being laterally adjustable to permit a variation in the size of the interior volume, to readily accommodate different hand sizes.

10. A child's mitten as recited in claim 8, wherein said complementary securement mean is a Velcro closure which include a hook portion located on one of said members and a loop portion on the other of said members said panel extension extends frothe one of said members which overlies the rear of the hand, said member containing the hook portion of the Velcro closure, the other member which overlies the palm of the hand including the loop portion of the VELCRO closure, the attachment of said hook portion being laterally adjustable, to readily accommodate different hand sizes with the lateral engagement of said Velcro hook and loop portions provides the variation in the size of the interior volume.

11. A child's mitten as recited in claim 1, wherein said complementary members extend downwardly to enclose the child's wrist area, said downward extensions being permanently knit together along an extension of the side edges of the complementary first and second members, which are permanenbly secured to each other.

12. A child's mitten formed of a unitary initially planar fabric piece;

said fabric piece including first and second members, each of said members including opposed first and second side edges and a top arcuate edge and a bottom edge;

said second member including a panel extending from its second said edge;

said first and second members folded over in overlying relationship to define an interior volume for the wearer's hand, with the second side edge of said first member secured to said first side edge of said second member; their bottom edges being unsecured and their top edges being secured;

said first edge of said first member and second edge of said second member being initially unsecured to each other and providing a continuation of the bottom opening to provide a substantial access opening to the interior volume;

said panel extension being foldable along its lengthwise securement to said second member. to overlap said first member and substantially enclose the side edges of said access opening; said panel extension and said first member including complementary readily releasable securement means for securing said panel extension to said first member when the child's hand is within the interior volume and said panel extension is in overlying relationship with respect to said first member.

13. A child's mitten, as recited in claim 12, wherein said securement means is a Velcro closure.

14. A child's mitten as recited in claim 12, wherein said unitary fabric piece is formed of a strectachable fabric.

15. A child's mitten as recited in claim 12, wherein said first and second members are secured to each other by a continuous line of stitching which extends along a substantial portion of the connected second side edge of said first member and first side edge of said second member, and the top arcuate top edges of said first and second members.

16. A child's mitten as recited in claim 15, wherein said Velcro securement means provides lateral adjustment of the overlying relationship between said panel extension and first member to permit a variation in the size of the interion volume, to snugly accommodate a predetermined variation in hand size.

* * * * *